United States Patent [19]

Burns

[11] 4,249,619

[45] Feb. 10, 1981

[54] DEVIATED DRILLING APPARATUS

[75] Inventor: Robert B. Burns, Huntington, N.Y.

[73] Assignee: Texaco Development Corporation, White Plains, N.Y.

[21] Appl. No.: 45,496

[22] Filed: Jun. 4, 1979

[51] Int. Cl.[3] ..... E21B 15/02; E21B 7/04

[52] U.S. Cl. ..... 175/9; 175/61

[58] Field of Search ..... 175/5, 8, 9, 61, 78, 175/79; 405/195, 224, 228

[56] References Cited

U.S. PATENT DOCUMENTS

| | | | |
|---|---|---|---|
| 4,030,310 | 6/1977 | Shirtzinger | 175/8 |
| 4,136,996 | 1/1979 | Burns | 175/8 X |

*Primary Examiner*—James A. Leppink
*Assistant Examiner*—Richard E. Favreau
*Attorney, Agent, or Firm*—Carl G. Ries; Robert A. Kulason; Robert B. Burns

[57] ABSTRACT

Marine structure adapted to be fixed to the ocean floor for drilling wellbores into the latter. A drill conductor cage is removably positioned within the marine structure at a submerged position. The cage holds one or more drill string or conductor guides in a manner that a number of directionally oriented wells can be drilled without movement of the structure. The cage is readily disengaged from its underwater working position to permit it to be raised to the water's surface and is then swung outboard of the platform's working deck. In such a position the addition and removal of drilling cnductors is facilitated without undue use of limited deck space on the platform.

8 Claims, 6 Drawing Figures

DEVIATED DRILLING APPARATUS

BACKGROUND OF THE INVENTION

In the drilling of offshore petroleum or gas producing wells from a fixed platform it is customary to insert a conductor member into the marine structure between the work deck and the wellhead. This conductor serves the primary purpose of enclosing the rotating drill string. Thus, drilling mud can be circulated through the drill string and returned to the pumps on the working deck.

In some instances where the petroleum-bearing reservoir is determined to be relatively close to the surface of the water, it is necessary to offset the rotating drill string rather quickly so it will assume a desired direction whereby to enter the reservoir. In shallow areas this offsetting of the drill string from vertical must be accomplished as soon as possible so that the drill will intersect the reservoir within a short period of time.

It is known that by initially deflecting the drill string such that it enters the ocean floor at a desired angle, the operation is expedited. In one method of achieving such directional drilling, the conductor is positioned within the offshore structure and initially aligned at an angle to the structure floor. Thus, the drill string, by being guided through the conductor, will enter the floor at a predetermined angle and direction.

It is also known that to effectuate the desired offset, the drill string can be initially forced from a vertical disposition into the desired entry angle. This is normally done through use of an elongated conductor guide which is carried within the body of a marine platform.

The guide comprises a heavy walled tube-like member which is performed into a desired curved configuration. The addition of curved or straight guide members to the underwater section of a marine structure after it has been placed at an offshore site is usually an expensive operation requiring the use of divers and other special equipment.

The instant invention therefore provides a novel arrangement in an offshore structure which serves the purpose of facilitating a directional drilling operation. It further serves to reduce overall operating expenses and provides the structure with a greater degree of versatility due to the greater number of wells that can be drilled from a single position. It also permits the positioning of drill conductor guides by suspending a drill conductor guide cage outboard of the structure, thereby avoiding the need for the cage to take up valuable deck space.

The marine structure presently contemplated is thus provided with ordinary drilling equipment such as derrick, rotary table and the like. However it is also provided with an elongated cage or substructure which serves as an underwater support member for a number of conductor guides. The cage can be detached from its normal submerged position in the marine structure and raised to the working deck. The cage is further provided with means for pivotally swinging the entire unit outboard of the working deck and into a substantially horizontal position which facilitates its being worked on.

Thus, the number of, or the pattern of conductor guides can be changed by addition to or removal of said guides to achieve a desired pattern at the ocean floor. The cage therefore will be swung back on board the platform and into a vertical position prior to being reinserted by lowering into its normal seating or working position. Thus, the original conductor guides, or the newly inserted guides, are aligned to permit further drilling in a particular direction from an initially upright disposition of the drill string.

It is therefore an object of the invention to provide a marine structure capable of drilling wellbores into the ocean floor and exhibiting great drilling versatility. A further object is to provide the marine drilling apparatus of the type contemplated which is particularly adept at drilling directionally away from a working site. A still further object is to provide an underwater drilling structure which can be conveniently worked on when it is raised to an above-water position adjacent to a marine platform's working deck.

Figure 1:
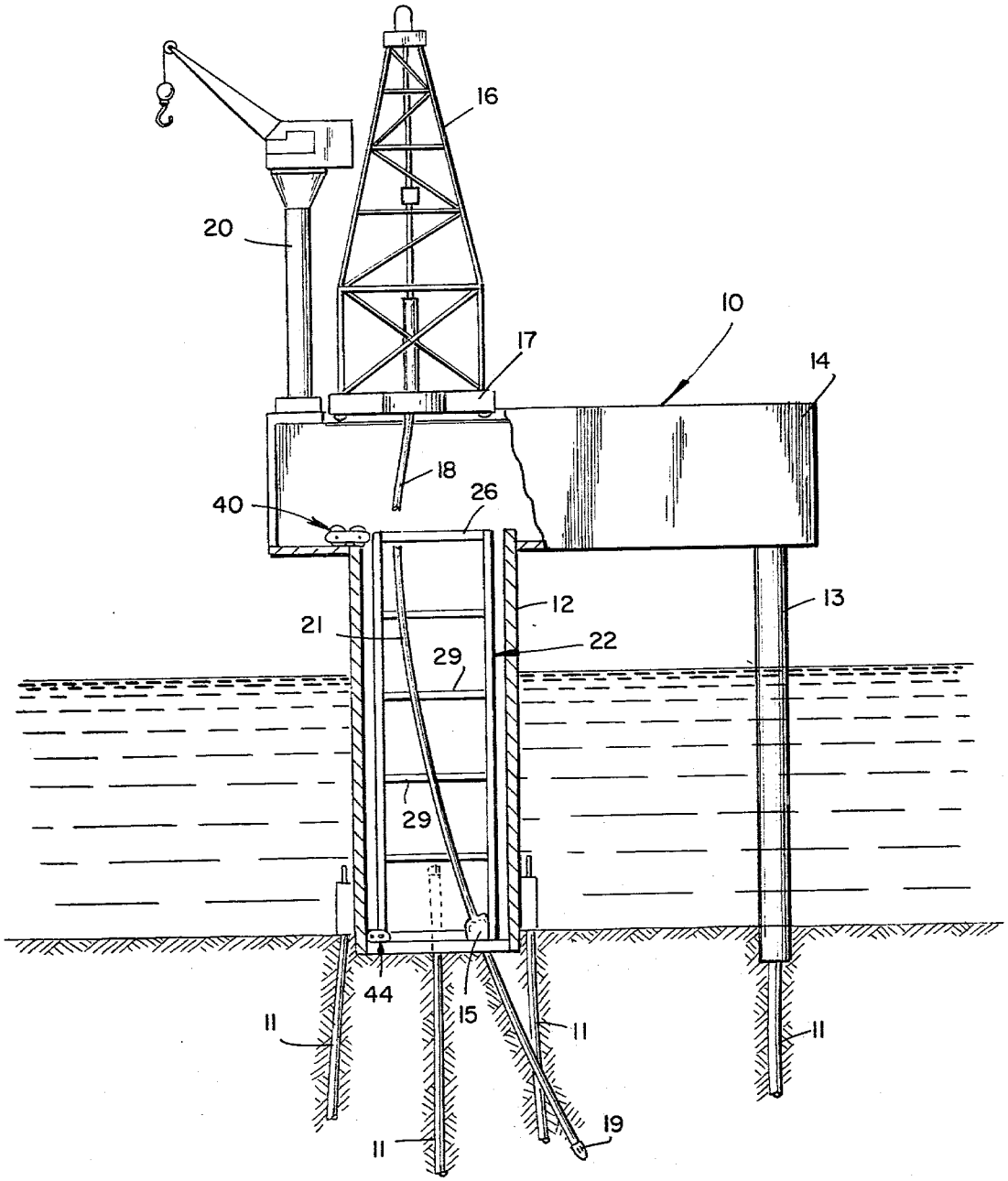
FIG. 1 is an environmental vertical elevation view in partial cross-section of the invention.

Referring to the drawings, a drilling structure 10 of the fixedly positioned type is shown, which structure utilizes the instant invention. Such an offshore structure or marine platform is normally barged or floated to a working site in a body of water and is there lowered into position. The latter is achieved by causing the structure to controllably sink into the water either by its own weight, by negative bouyancy, or by being lowered from a barge, vessel or the like.

With the structure in a resting position on the ocean floor, piles 11 are normally driven into the substrate through or about the various support legs 12 and 13 of the structure. A wellhead 15 is initially positioned at the ocean floor having means to engage a conductor 21 thereby providing a closed guide for the lowered drill string.

For normal drilling purposes, the structure's raised deck 14 is provided with a derrick 16, a rotary table 17, and similar ancillary equipment known in the industry for such an operation. Functionally, derrick 16 will support a drill string 18 through rotary table 17, in a generally vertical position. As the rotating string is lowered toward the substrate it will commence its drilling operation in a vertical direction.

There are well known drilling techniques for diverting a drill string from its original vertical disposition after it enters the substrate. Such techniques can be exercised by the driller to urge or deviate the drill a desired degree away from vertical, into a particular direction. In the present arrangement the rotating drill head 19 is lowered into a conductor guide 21, thence through wellhead 15. Conductor guide 21 is curved at the lower end and straight at the upper end. In any event, as the rotating drill string 18 proceeds through the tube-like guide, it will be urged or divered into the desired direction, following the contour of the guide walls.

In one embodiment of the apparatus, a removable conductor cage is suspended directly from the working deck 14 beneath rotary table 17. Said cage 22 is thus substantially submerged in the water at the drilling site even though the upper portion might be exposed. However, because of waves, water currents, floating ice and the like, the exposed conductor or riser is often excessively stressed. Consequently it is preferably enclosed within a protective caisson or platform leg, and more conveniently within the heavy walled platform legs.

In one arrangement, and as shown in FIG. 1, cage 22 holding the respective conductor guides 21 is removably positioned longitudinally of, and within one of the support legs 12. Thus, even though structure 10 is provided with a plurality of, and usually at least four upstanding legs, any leg can be adapted to accommodate drilling cage 22.

Cage 22 is slidably received within leg 12 and can be moved longitudinally therethrough with the aid of derrick 16 or similar equipment which can be connected to the cage. Both the cage and the leg inner wall are provided with tracks or other means, not shown in detail, by which movement of cage 22 is guidably limited during passage through the leg interior.

When the lower end of cage 22 has been raised, and is adjacent to the upper end of leg 12, the cage is fastened to the leg at a hinge point 40. Thereafter, the entire cage is pivotally lowered about the hinge point, still supported by derrick 20, into a horizontal disposition. A major portion of the cage is thus disposed outboard of the marine structure deck 14, being supported by hinge 40 and derrick 20.

One embodiment of each hinge point 40 is formed by a pair of displaceable hinge blocks 41 and 42 which are in turn operably pinned to bracket 38 on leg 12, and can be swung out of place when not in use. Each block is provided with an opening to removably receive a hinge pin 43. Thus, as the hinge tongue 44 on cage 22 is raised into and aligned with blocks 41 and 42, pin 43 can be readily slidably inserted to provide the desired hinge joint.

Figure 2:
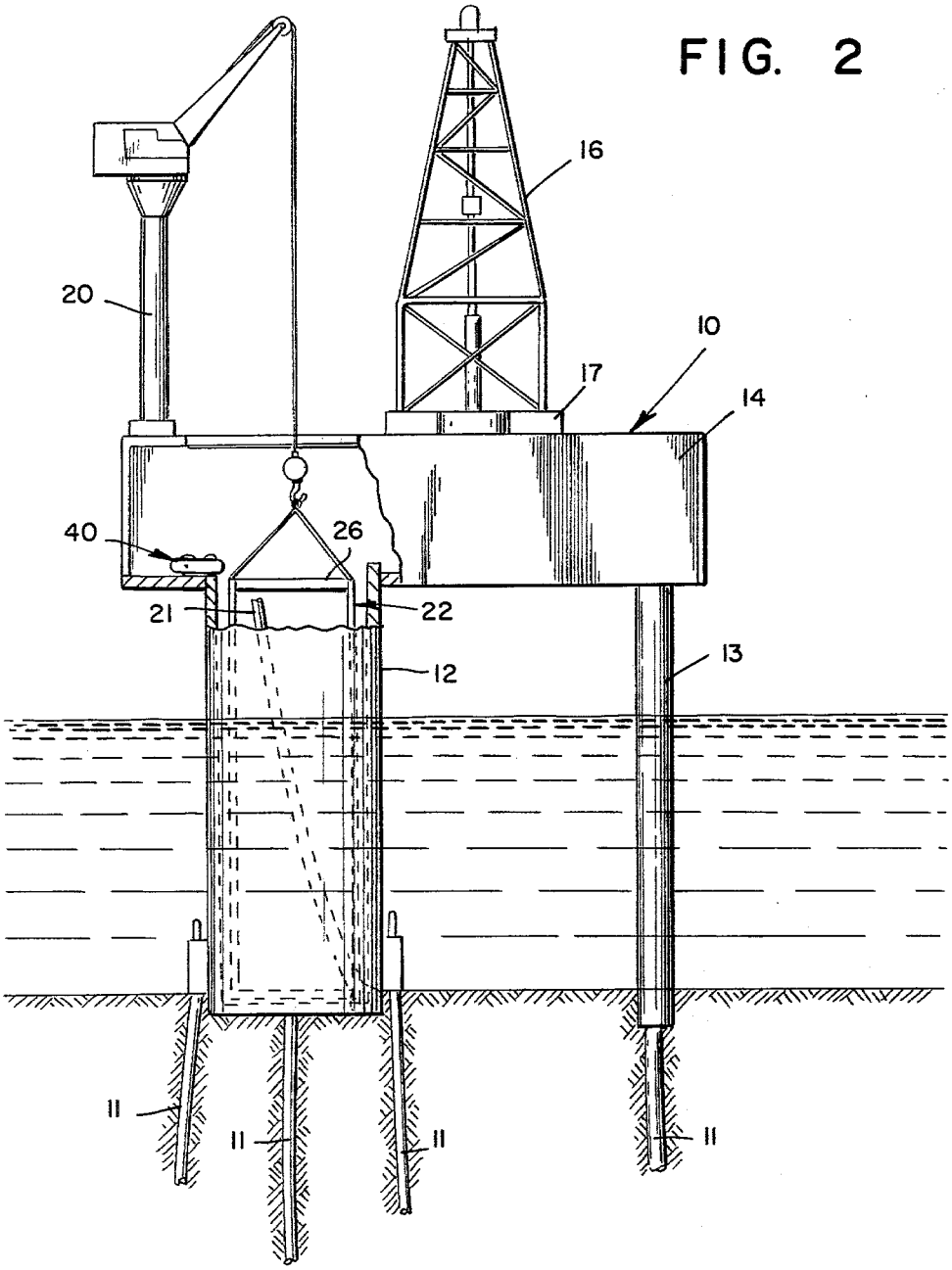
FIGS. 2 and 3 are similar to FIG. 1.
Figure 5:
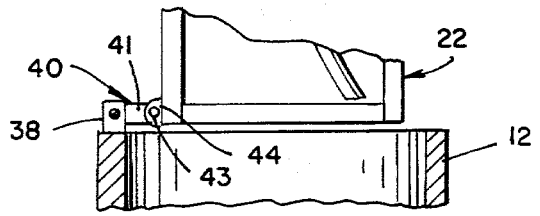
FIG. 5 is a cross-sectional view taken along line 5—5 in FIG. 4.
Figure 3:
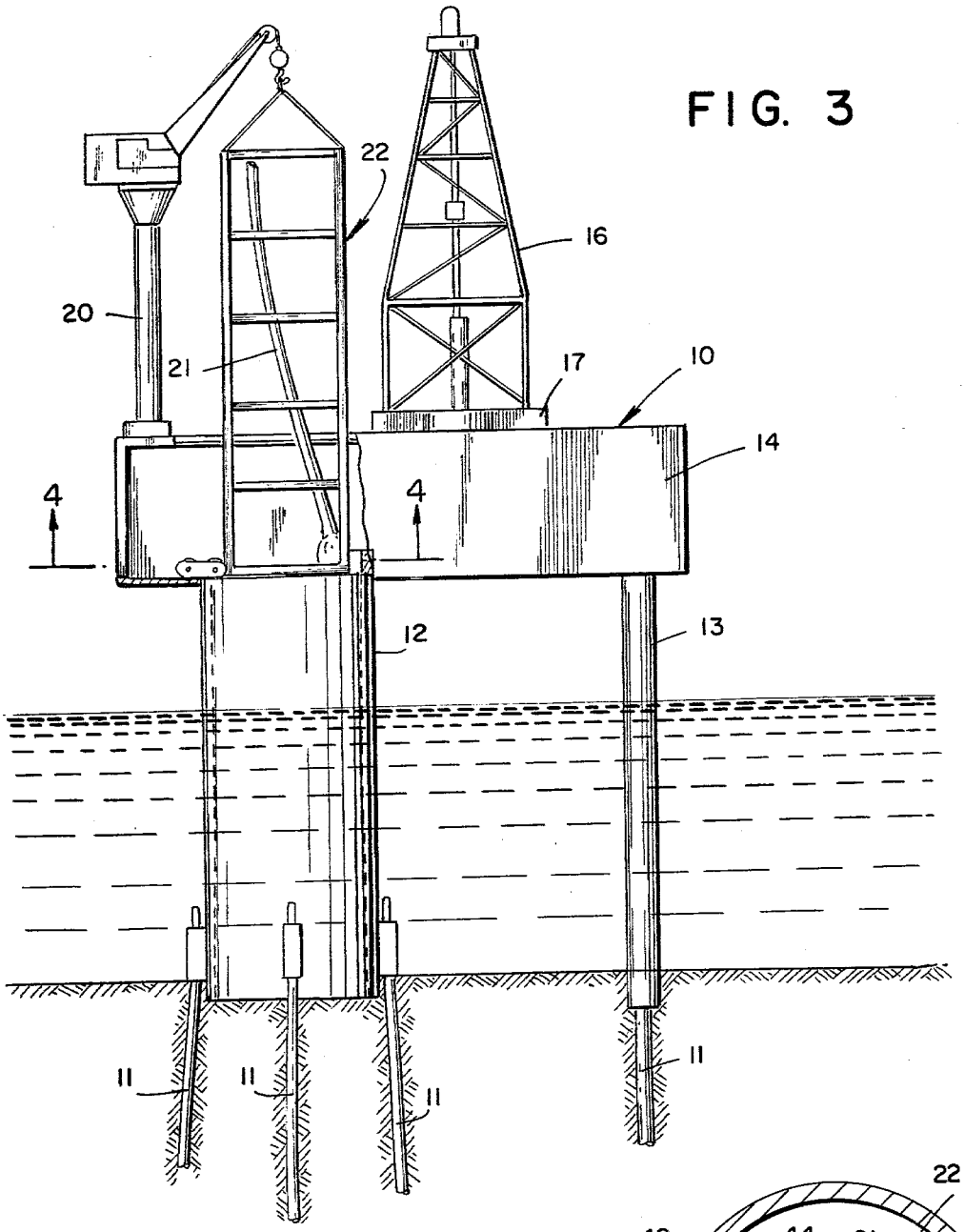
Figure 4:
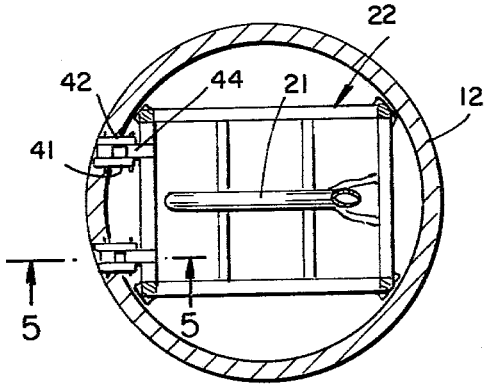
FIG. 4 is a cross-sectional view taken along line 4—4 in FIG. 3.
Figure 6:
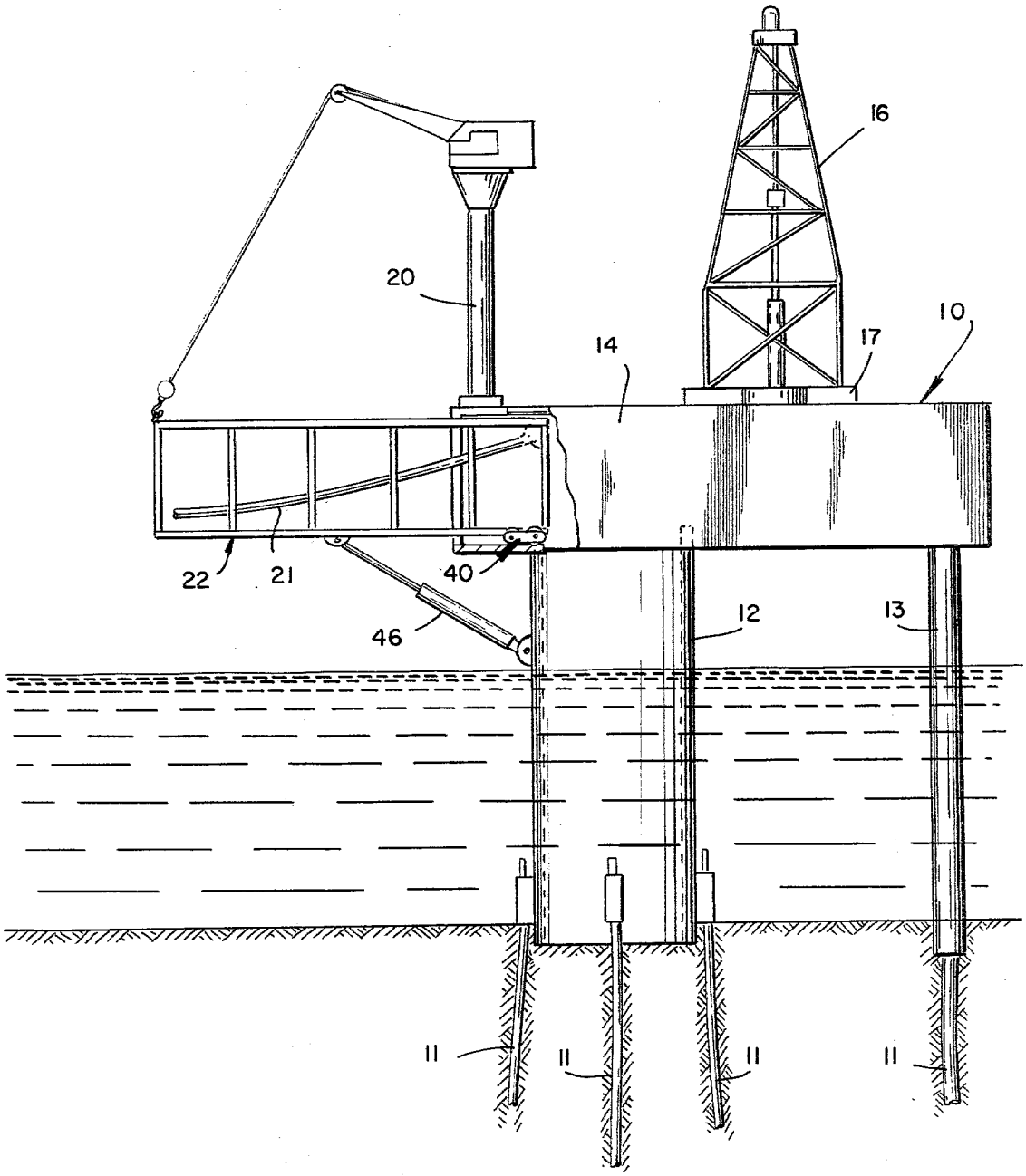
FIG. 6 is similar to FIG. 1.

Referring to FIG. 2, when cage 22 is suspended from derrick 20 and disposed outboard of deck 14, it is readily supported, and does not interfere with operating equipment on the deck 14. Further, it can be easily worked on by crew members and is accessible for adding or adjusting drilling guides to accommodate a further drilling operation.

When cage 22 is again ready for underwater use, it is pivotally raised about hinge point 40 into a vertical disposition above leg 12. After the hinge pin 43 is withdrawn to release the cage, blocks 41 and 42 are displaced. The cage can now be lowered through leg 12 and there fastened in its underwater operating position.

Preliminary to a well drilling operation, platform or structure 10 is floated to a working site in a body of water, and it is lowered, as previously mentioned, into position in a substantially vertical disposition. The number of piles 11 which are utilized to fasten the platform in place will be a function of the consistency of the substrate at that location. Also, the character of the water and other natural conditions will determine the pile arrangement for properly maintaining the platform in place, and in view of the directional drilling plan.

When platform 10 is rigidly fastened, conductor cage 22 as shown will be removably supported within enlarged legs 12. Structurally, cage 22 comprises upper and lower collars 26 and 27 respectively. These collars are fixedly spaced apart by a plurality of intermediate stringer members 28. A series of lateral braces 29 serve to further rigidize the cage's structure and support conductors 21.

Cage 22 as presently shown holds a single conductor 21. However, as a matter of practicality, the cage can, and normally does embody several such members. One or more of the conductors are usually inserted into the cage 22 prior to installation of the latter on the structure itself. Other conductors can subsequently be installed after the platform has been erected at its working position and a desired drilling pattern is determined.

In the instance shown, the respective conductors 21 are curved. The upper or entering end of the conductor is aligned substantially vertically to receive a downwardly moving drill string 18. Thus, the rotating drill string will be urged in the direction as determined by the curvature and alignment of conductor guide 21.

To drill a deviated well in the particular direction away from the platform 10, the conductor 21 as shown is prefabricated with the desired uniform curvature. This curvature will be sufficient to provide the desired direction and angle with respect to the ocean floor without unduly stressing the string. The degree of conductor curvature is generally such as to permit free rotation of the drill string 18 and yet accomplish the desired offsetting from the vertical. As a rule of thumb, a reasonable offset is deemed to be approximately 6° for every 100 feet of vertical distance.

At such time as conductor 21 is properly aligned, the rotating drill string is lowered by derrick 16 in the normal manner to enter the conductor upper end. Drill string 18, lubricated by a suitable drilling fluid, will then progress by its own weight downwardly through the curved guide tube until it passes from the lower end.

In accordance with the usual drilling practice, conductor guide 21 is fastened at its lower end to a wellhead 15 or similar apparatus, to in effect form a closed conduit. Thus, drilling mud can be pumped and circulated through the drill string and returned through the conductor guide to provide the necessary lubrication and other functions normally achieved by the mud.

At such time as the desired well has been completed, a determination will be made whether to drill further wells and in what direction. The drilled well is therefore capped or is provided with flow control apparatus. If the initial well is found to have entered a producing reservoir, normally additional wells will be similarly drilled.

Thereafter, rather than installing another conductor guide into conductor cage 22 while the latter is submerged, the cage is disconnected from leg 12. After derrick 16 and rotary 17 have been temporarily displaced on deck 14, the cage can be raised in its entirety from the water either with the aid of derrick 14 or through a similar hoisting means.

When the cage lower end has been raised to the level of the top of leg 12 it is brought to rest. The lower end of cage 22 is then connected to leg 12 by first swinging hinge blocks 41 and 42 inwardly to align them with tongue 44. Hinge pin 43 is then inserted to operably connect the spaced apart hinge blocks 41 and 42 with tongue 44. When so connected, the cage is in position to be lowered from a vertical disposition with respect to leg 12.

After the cage has been lowered or swung outboard to its substantially horizontal disposition, one or more braces 46 which extend outwardly from leg 12 can be moved into place to engage the cage underside. Said braces can be of the telescoping type to permit longitudinal adjustment thereof as the cage is adjusted. This will provide uniform support to the cage along its length during its overhanging periods.

With the cage 22 extended beyond the sides of deck 14, additional conductors can be installed by workmen operating from a boat or from the cage itself. Alternately, original conductors 21 can be replaced as needed. This operation is achieved without substantially disturbing other deck equipment since it is done entirely outboard of the marine structure.

With the cage 22 now ready for use with new or additional conductors 21 in place, the cage can as herein noted be raised to a vertical disposition. This is achieved by disconnecting the various braces 46 and thereafter hoisting the upper end of the cage to a vertical alignment. Thereafter, the hinge pins 43 are removed, blocks 41 and 42 swing outboard, and the cage is again free to be guidably lowered through leg 12 to its working position.

With the conductor cage now firmly fastened to leg 12, the derrick 16 can be again moved into place. Similarly rotary 17 can be aligned above the newly added conductor which will receive the drill string. Thereafter the normal drilling operation can be achieved by lowering the drill string and permitting the same to be deflected in the direction as dictated by the newly inserted conductor.

Other modifications and variations of the invention as hereinbefore set forth can be made without departing from the spirit and scope thereof. Therefore only such limitations should be imposed as are indicated in the following claims.

I claim:

1. A marine structure for drilling deviated wells into the ocean floor at an offshore body of water, said structure including; a deck which is positioned above the water's surface to hold well drilling equipment including a rotatable drill string, at least one upstanding leg supportably connected to said deck and extending downwardly to said ocean floor, a conductor cage extending downwardly from said deck and through said upstanding leg when said cage is in the drilling position, and at least one conductor guide in said cage aligned to receive a descending drill string, said conductor cage being upwardly movable through said leg whereby to raise the cage lower end to a position adjacent to the leg upper end, and hinge means on said leg adapted to provisionally engage said cage lower end whereby to permit the cage to be pivotally rotated about said hinge to a substantially horizontal plane.

2. In the apparatus as defined in claim 1, wherein said cage, when pivotally rotated about said hinge means, will overhang the edge of said deck.

3. In the apparatus as defined in claim 1, wherein said cage, when pivotally rotated about said hinge means, will overlie the water adjacent to said deck.

4. In the apparatus as defined in claim 1, including; a first hinge member on said cage having a pin bore, a second hinge member on said leg having a second pin bore, and a hinge pin removably registered within said first and second hinge bores, respectively.

5. In the apparatus as defined in claim 1, wherein said hinge means is disposed at the outboard side of said leg whereby said cage can be lowered to a position overlying the water adjacent to said leg.

6. In the apparatus as defined in claim 1, wherein said upstanding leg includes; at least one brace member extending outwardly therefrom, being adapted to support said conductor cage when the latter is disposed in a horizontal position.

7. In the apparatus as defined in claim 6, wherein said brace member includes; a telescoping portion being operable to adjust the length of said brace member while supporting said cage.

8. In the apparatus as defined in claim 6, wherein said brace member includes; an elongated telescoping portion having one end pivotally depending from said leg, the other end thereof being operable to provisionally engage said cage when the latter is in the horizontal position.

* * * * *